US006688687B2

(12) United States Patent
Chu

(10) Patent No.: US 6,688,687 B2
(45) Date of Patent: Feb. 10, 2004

(54) BACKREST WITH ADJUSTABLE LUMBAR SUPPORT

(75) Inventor: Zooey Chu, Grand Rapids, MI (US)

(73) Assignee: Global Total Office, Downsview (CA)

( * ) Notice: Subject to any disclaimer, the term of this patent is extended or adjusted under 35 U.S.C. 154(b) by 196 days.

(21) Appl. No.: 10/028,961

(22) Filed: Dec. 20, 2001

(65) Prior Publication Data

US 2002/0093233 A1 Jul. 18, 2002

Related U.S. Application Data

(63) Continuation of application No. PCT/CA01/00920, filed on Jun. 19, 2001, which is a continuation-in-part of application No. 09/597,444, filed on Jun. 20, 2000, now Pat. No. 6,378,942.

(51) Int. Cl.[7] ..... A47C 3/025
(52) U.S. Cl. ..... 297/284.4
(58) Field of Search ..... 297/284.1, 284.4

(56) References Cited

U.S. PATENT DOCUMENTS

| | | | | |
|---|---|---|---|---|
| 2,843,195 | A | | 7/1958 | Barvaeus |
| 2,991,124 | A | * | 7/1961 | Schwarz |
| 3,121,592 | A | * | 2/1964 | Anderson |
| 3,203,734 | A | | 8/1965 | Seymer |
| 4,156,544 | A | | 5/1979 | Swenson et al. |
| 4,350,388 | A | | 9/1982 | Weiner |
| 4,632,454 | A | | 12/1986 | Naert |
| 4,810,033 | A | | 3/1989 | Kemmann |
| 4,892,356 | A | | 1/1990 | Pittman |
| 5,286,083 | A | | 2/1994 | Mattison |
| 5,328,245 | A | | 7/1994 | Marks et al. |
| 5,385,388 | A | | 1/1995 | Faiks et al. |
| 5,385,389 | A | | 1/1995 | Bishai |
| 5,423,593 | A | | 6/1995 | Nagashima |
| 5,567,010 | A | | 10/1996 | Sparks |
| 5,624,158 | A | | 4/1997 | Adat et al. |
| 5,651,583 | A | * | 7/1997 | Klingler et al. |
| 5,718,476 | A | | 2/1998 | De Pascal et al. |
| 5,752,741 | A | | 5/1998 | Bort |
| 5,769,491 | A | | 6/1998 | Schwarzbich |
| 5,842,264 | A | | 12/1998 | Roossien et al. |
| 5,913,569 | A | * | 6/1999 | Klingler |
| 5,997,094 | A | | 12/1999 | Cvek |
| 6,013,040 | A | | 1/2000 | Morgenstern et al. |
| 6,079,785 | A | | 6/2000 | Peterson et al. |
| 6,186,594 | B1 | | 2/2001 | Valiquette et al. |

FOREIGN PATENT DOCUMENTS

| | | |
|---|---|---|
| GB | 1423617 | 2/1976 |

* cited by examiner

*Primary Examiner*—Milton Nelson, Jr.
(74) *Attorney, Agent, or Firm*—Michael Best & Friedrich LLP

(57) ABSTRACT

A backrest for supporting a person's back having a front surface and a rear surface has a flexible support section having a fixed end which is mounted to a support structure and a free end which is displaceable vertically with respect to the fixed end, the support section is configured to be compressed and displaced forwardly when the free end is moved towards the fixed end. In one embodiment, an adjustment member is drivingly connected to the free end; and, a detent member for selectively receiving the adjustment member in one of a plurality of positions, the support member biasing the adjustment member into retaining engagement with the detent member due to the compression of the flexible support member by the displacement of the free end towards the fixed end. In another embodiment, a cam mounted off-center on a shafted controls the compression of the support structure.

34 Claims, 10 Drawing Sheets

BACKREST WITH ADJUSTABLE LUMBAR SUPPORT

This application is a continuation of PCT patent application No. PCT/CA01/00920, filed Jun. 19, 2001, which is a continuation-in-part of U.S. patent application Ser. No. 09/597,444, filed Jun. 20, 2000, now U.S. Pat. No. 6,378,942, issued Apr. 30, 2002.

FIELD OF THE INVENTION

This invention relates to backrests for chairs. More particularly, the invention relates to a backrest that provides adjustable support to the lumbar region of the back of a user seated on a chair.

BACKGROUND OF THE INVENTION

Backrests that provide lumbar support are known. Many of these have a non-adjustable lumbar support. The lumbar support is built into the back rest and may therefore be configured to provide adequate support for a typical person. In practice, such backrests provide inadequate support for people who are larger or smaller than average. Adjustable lumbar supports are also known, however, these devices tend to have complex adjustment mechanisms that are both heavy and costly.

For example, Kemmann describes an adjustable backrest in U.S. Pat. No. 4,810,033. This backrest has an outer frame that holds a deformable plate that provides lumbar support. The top portion of the plate (i.e. the region of the plate nearer the upper back of a user) is formed into a series of longitudinal slats, running from the top of the lumbar support to its center. The lower portion of the lumbar support plate (i.e. the portion which actually supports the user's back) does not have any openings and is less flexible. A control knob is drivingly connected to the plate through a complex mechanism and is rotatably mounted to change the position of the lower portion of the plate to force the plate outwardly such that the plate provides lumbar support.

One disadvantage of lumbar adjustment mechanisms is that they utilize complex and costly adjustment mechanisms. Therefore, they tend to be provided on more expensive chairs. Thus they may be provided on chairs for executives and professionals but not on secretarial chairs who would also benefit from a more ergonomic chair. Further, due to the complexity of the mechanism, the mechanism is prone to breaking.

SUMMARY OF THE INVENTION

In accordance with one aspect of the instant invention, there is provided a backrest for supporting a person's back having a front surface and a rear surface, the backrest comprising: a member having an outer perimeter and a flexible support section, the flexible support section having a fixed end which is connected to a portion of the perimeter and a free end positioned distal to the fixed end, the flexible support section is configured to be displaced forwardly when the free end is moved towards the fixed end; an adjustment member drivingly connected to the free end; and a locking member for retaining the free end at a fixed position with respect to the fixed end.

In one embodiment of the invention, the flexible support section biases the free end to engage the locking member.

In another embodiment, the locking member comprises a detent member for selectively receiving the adjustment member in one of a plurality of positions, the flexible support section biasing the adjustment member into retaining engagement with the detent member due to the compression of the flexible support member by the displacement of the free end towards the fixed end.

In another embodiment, the fixed end comprises an upper end and the free end comprises a lower end and the detent member comprise a plurality of vertically spaced apart members each of which has a downwardly extending recess and the adjustment member is sized to be received in each recess.

In another embodiment, the detent member comprises a plurality of vertically spaced apart members each of which has a recess to receive therein the adjustment member and support member biases the adjustment member into engagement with the recesses.

In another embodiment, the backrest has a rear face with a vertically extending opening adjacent the free end, the adjustment member is mounted at the free end of the support structure and has a handle which extends through the vertically extending opening whereby the flexible support section may be adjusted from the rear of the backrest.

In another embodiment, locking member comprises a detent and gear arrangement.

In another embodiment, the gear arrangement is mounted on a shaft and the adjustment member comprises a cam eccentrically mounted on the shaft.

In another embodiment, the adjustment member comprises an eccentrically mounted cam.

In another embodiment, the backrest comprises a frame and the member comprises a shell mounted on the frame.

In another embodiment, the frame has an opening sized to receive therein the flexible support section.

In another embodiment, the flexible support section comprises a plurality of slats extending vertically between the fixed end and the free end of the flexible support section.

In another embodiment, the slats extend from a position adjacent the fixed end to a position adjacent the free end.

In another embodiment, the perimeter section surrounds a central section in which the flexible support section is provided and, when mounted on a chair, the support structure has a vertical extent sufficient to support at least the lumbar region of the person when seated in the chair.

In another embodiment, the shell has first engagement members and the frame has second engagement members configured to engage the first engagement members whereby the engagement of the first and second engagement members retains the shell on the frame.

In another embodiment, the first engagement members and the second engagement members comprise a plurality of openings and the other of the first and second engagement members comprises projecting members that are locking received in the openings.

In another aspect of the invention, there is provided a backrest for supporting a user's back having a front surface and a rear surface, the backrest comprising: a frame; a shell mounted on the frame, the shell having a flexible support section; and first engagement members provided an the shell and second engagement members provided on the frame, the second engagement members are configured to engage the first engagement members whereby the engagement of the first and second engagement members retains the shell on the frame.

In another embodiment, one of the first engagement members and the second engagement members comprise a plurality of openings and the other of the first and second engagement members comprises projecting members that are locking received in the openings.

In another embodiment, the shell comprises a perimeter section surrounding a central section in which the flexible support section is provided and, when mounted on a chair, the flexible support section has a vertical extent sufficient to support at least the lumbar and mid back regions of the person when seated in the chair.

In another embodiment, the frame has an opening sized to receive therein the flexible support section.

In another embodiment, the flexible support section comprises a plurality of slats extending vertically between the perimeter of the flexible support section.

Another aspect of the invention provides a backrest for supporting a user's back having a front surface and a rear surface, the backrest comprising: a shell having a perimeter section surrounding a central section and a plurality of slats extending vertically between the perimeter to occupy the central section and, when mounted on a chair, the slats have a vertical extent sufficient to support at least the lumbar and mid back regions of the person when seated in the chair; a frame having an opening sized to receive therein the slats; and, mounting members to mount the shell on the frame.

In another embodiment, the mounting members comprise first engagement members provided an the shell and second engagement members provided on the frame, the second engagement members are configured to engage the first engagement members whereby the engagement of the first and second engagement members retains the shell on the frame.

In another embodiment, the first engagement members and the second engagement members comprise a plurality of openings and the other of the first and second engagement members comprises projecting members that are locking received in the openings.

Another aspect of the invention provides a backrest for supporting a person's back having a front surface and a rear surface, the backrest comprising: a flexible support section having a fixed end which is mounted to a support structure and a free end which is displaceable vertically with respect to the fixed end, the support section is configured to be compressed and displaced forwardly when the free end is moved towards the fixed end; an adjustment member drivingly connected to the free end; and, a detent member for selectively receiving the adjustment member in one of a plurality of positions, the support member biasing the adjustment member into retaining engagement with the detent member due to the compression of the flexible support member by the displacement of the free end towards the fixed end.

In another embodiment, the support structure comprises a frame and a shell mounted on the frame and the support section is provided as part of the shell In another embodiment, the frame has an opening sized to receive therein the support section In another embodiment, In another embodiment, the support member comprises a plurality of slats extending vertically between the fixed end and the free end of the support section.

In another embodiment, the slats extend from a position adjacent the fixed end to a position adjacent the free end.

In another embodiment, the shell comprises a perimeter section surrounding a central section in which the support structure is provided and, when mounted on a chair, the support structure has a vertical extent sufficient to support at least the lumbar region of the person when seated in the chair.

In another embodiment, the shell has first engagement members and the frame has second engagement members configured to engage the first engagement members whereby the engagement of the first and second engagement members retains the shell on the frame.

In another embodiment, one of the first engagement members and the second engagement members comprise a plurality of openings and the other of the first and second engagement members comprises projecting members that are locking received in the openings.

In another embodiment, the fixed end comprises the upper end and the free end comprises the lower end and the detent member comprise a plurality of vertically spaced apart members each of which has a downwardly extending recess and the adjustment member is sized to be received in each recess.

In another embodiment, the detent member comprises a plurality of vertically spaced apart members each of which has a recess to receive therein the adjustment member and support member biases the adjustment member into engagement with the recesses.

In another embodiment, the frame has a front face and a vertically extending opening adjacent the free end, the shell is mounted on the front face, the adjustment member is mounted at the free end of the support structure and has a handle which extends through the vertically extending opening whereby the support structure may be actuated from the rear of the backrest.

Another aspect of the invention provides a backrest for supporting a person's back having a front surface and a rear surface, the backrest comprising: a flexible support section having a fixed end which is mounted to a support structure and a free end which is displaceable vertically with respect to the fixed end, the support section is configured to be compressed and displaced forwardly when the free end is moved towards the fixed end; an eccentrically mounted cam drivingly connected to the free end; and a locking member for retaining the free end at a fixed position with respect to the fixed end.

In another embodiment, the locking member comprises a detent and gear arrangement.

In another embodiment, the gear arrangement is mounted on a shaft.

In another embodiment, compression of the flexible support section biases the free end into engagement with the cam.

In another embodiment, compression of the flexible support section biases at least one tooth of the gear into locking engagement with the detent member.

In another embodiment, the flexible support section comprises a plurality of slats extending vertically between the fixed end and the free end of the support section.

In accordance with another aspect of the instant invention, there is provided a backrest a backrest for supporting a user's back having a front surface and a rear surface, the backrest comprising a shell having a perimeter section surrounding a central section and a plurality of slats extending vertically between the perimeter to occupy the central section and, when mounted on a chair, the slats have a vertical extent sufficient to support at least the lumbar and mid back regions of the person when seated in the chair; a frame having an opening sized to receive therein the slats; and mounting members to mount the shell on the frame. This construction provides a simple and easily manufacturable flexible back rest for a chair.

The construction provides a lumbar adjustment mechanism which may be provided on a chair at a price point such that the chair may be purchased for non-executive positions such as secretaries, paralegals and the like. In addition, the mechanism is robust so that a chair encompassing this feature will provide reliable service.

BRIEF DESCRIPTION OF THE DRAWINGS

These and other advantages of the present invention will now be explained, by way of example only, with reference to the drawings in which.

DETAILED DESCRIPTION OF THE PREFERRED EMBODIMENT

In accordance with one aspect of the instant invention, a backrest is constructed as a frame and shell arrangement. Each of the frame and shell may be molded so as to provide a strong yet light weight construction. The shell and frame are assembled together to from a backrest assembly for a chair. The frame and shell may be connected together by various means such as a chemical adhesive (e.g. glue), or mechanical means (e.g. male and female engagable members or welding). Preferably, each of the frame and the shell is molded with a plurality of interengagable members (e.g. see FIGS. 3 and 4) to secure the frame and shell together.

In accordance with another aspect of this invention, the backrest includes an adjustable lumbar support member. The lumbar support member may be adjusted by mechanical actuation (e.g. see FIG. 5 or FIGS. 14 and 15). However, the adjustment mechanism may be motorized. It will be appreciated that the lumbar adjustment mechanism may be used in any backrest assembly. For convenience, both the frame and shell assembly and the lumbar adjustment mechanism are shown in the Figures.

In accordance with another aspect of the instant invention, a backrest which conforms to the back of the user is provided. The conformable backrest need not include an adjustable lumbar support. For convenience, the Figures show how the adjustable lumbar support could be included in the conformable backrest.

Figure 2:
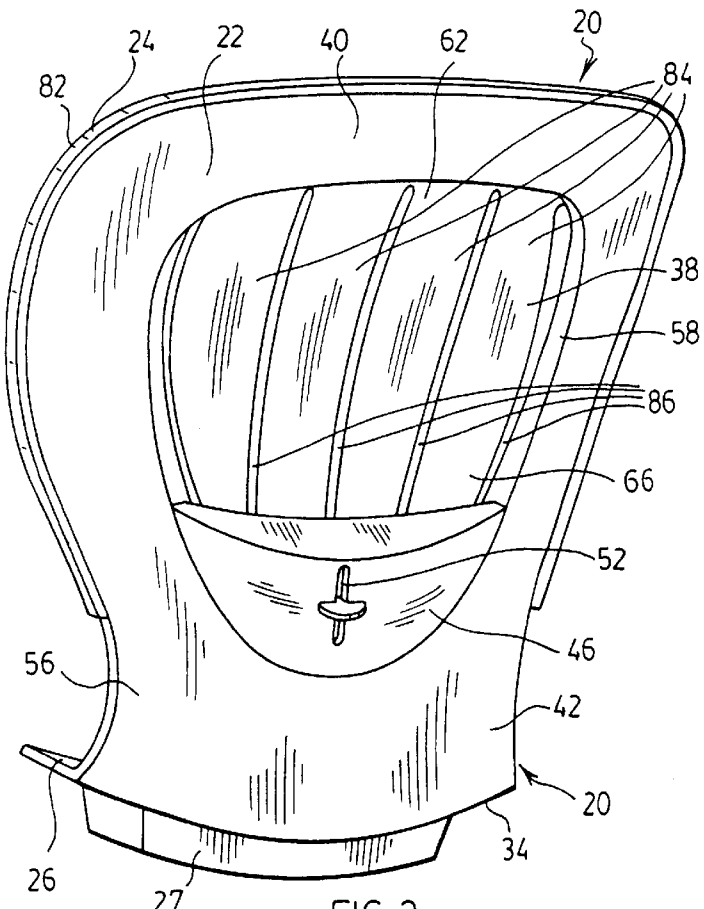
FIG. 2 is a rear perspective view of the backrest of FIG. 1.
Figure 1:
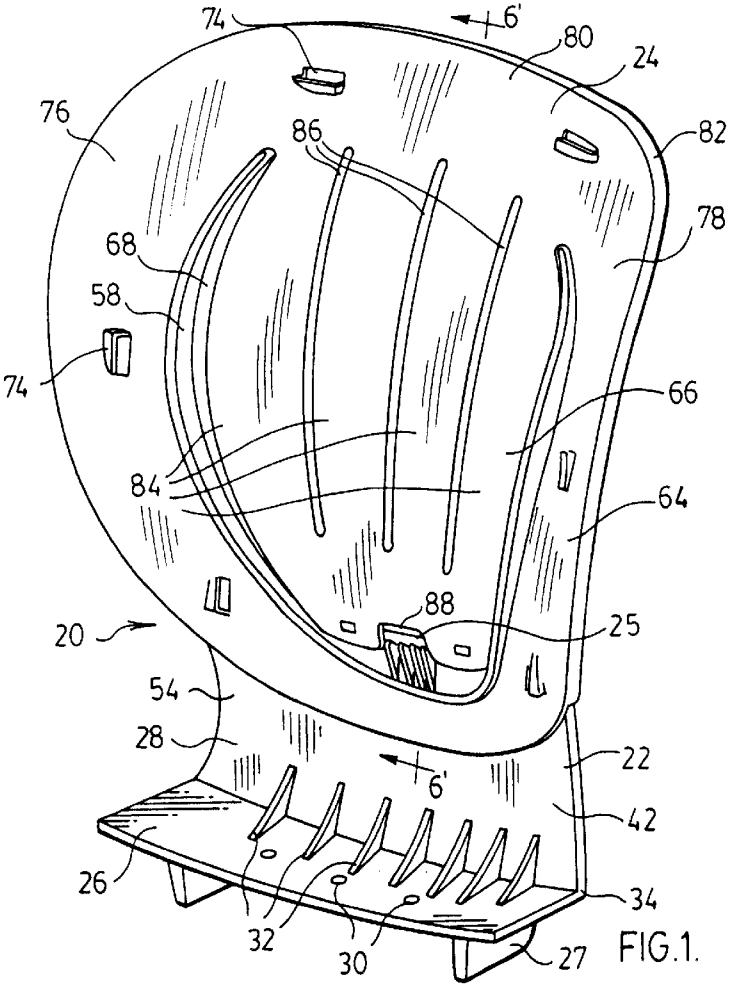
FIG. 1 is a front perspective view of a first embodiment of a backrest according to the present invention.

Reference is first made to FIGS. 1 and 2, which show an exemplary backrest 20 made according to the present invention which includes the conformable backrest, the shall and frame construction and the adjustable lumbar support. Backrest 20 is comprised of a frame 22 (see FIG. 3), a support shell 24 (see FIG. 4), a lever 25 (see FIG. 5) and is adapted to be mounted to a chair having a seat.

Figure 3:
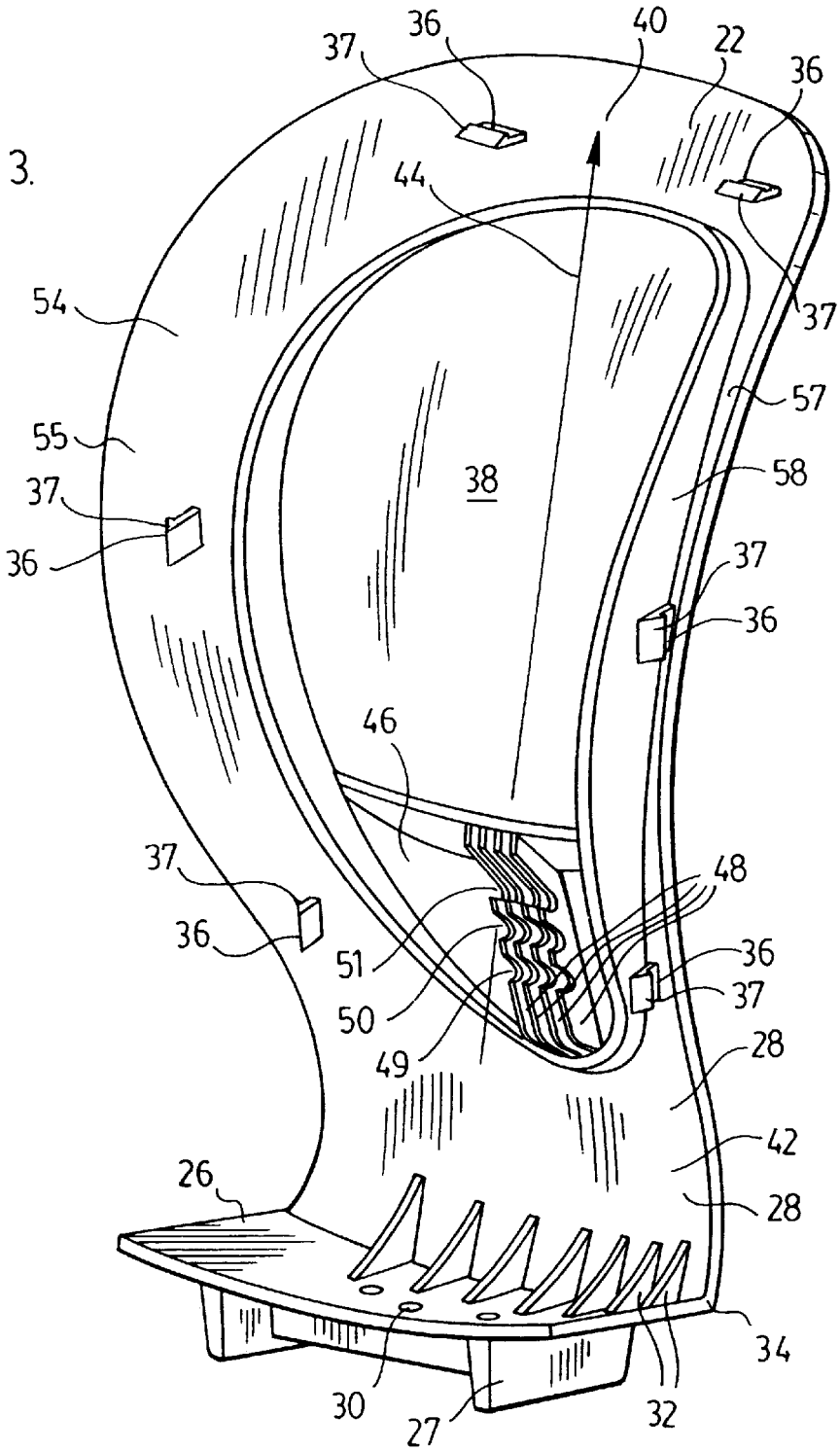
FIG. 3 is a front perspective view of the frame of the backrest of FIG. 1 without the lumbar support shell.

Frame 22 may be of any particular shape that provides a mount for receiving support shell 24. As shown in FIGS. 1, 2, and 3, frame 22 has a top 40, a bottom 42, and generally vertically extending sides 55 and 57 extending between top 40 and bottom 42. Top 40 and bottom 42 define a longitudinal or vertical axis 44. Top 40, bottom 42 and sides 55, 57 define the outer perimeter of frame 22. Frame 27 has front and rear surfaces 54 and 56.Preferably, backrest 20 is covered with padding (eg. foam) and a covering (eg. cloth or leather). As such, except for the added dimension contributed by the padding and covering, the outer perimeter of backrest 20 is substantially the same as that of frame 22. If a backrest includes the conformable backrest structure, then the foam is preferably selected to pad the backrest but to permit the backrest to change profile to match the back a person seated in the chair.

Frame 22 may be mounted to the chair by any means known in the art. Thus backrest 20 may be mounted to the seat support of the chair or to the seat itself using any fastening means known in the art. In the embodiment shown in FIGS. 1, 2 and 3, frame 22 has a mounting section 26 at its bottom which may be mounted either to a seat support of a chair or to a seat itself. Base section 28 extends between mounting section 26 and bottom 42. Mounting section 26 and base section 28 meet at corner 34. Mounting section 26 has a number of mounting holes 30 that may be used to mount frame 22 onto a seat or base of a chair (not shown) by e.g. screws, rivets or the like. Optionally, mounting section 26 has a U-shaped reinforcing ridge 27 extending from the lower surface of mounting section 26. Reinforcing ridge 27 increases the rigidity of mounting section 26 so that it will not substantially flex during use. Mounting section 26 and base section 28 are preferably connected by a number of ribs 32. Ribs 32 provide increased strength at corner 34 so as to ensure that mounting section 26 and base section 28 are not easily pulled apart at corner 34.

Figure 4:
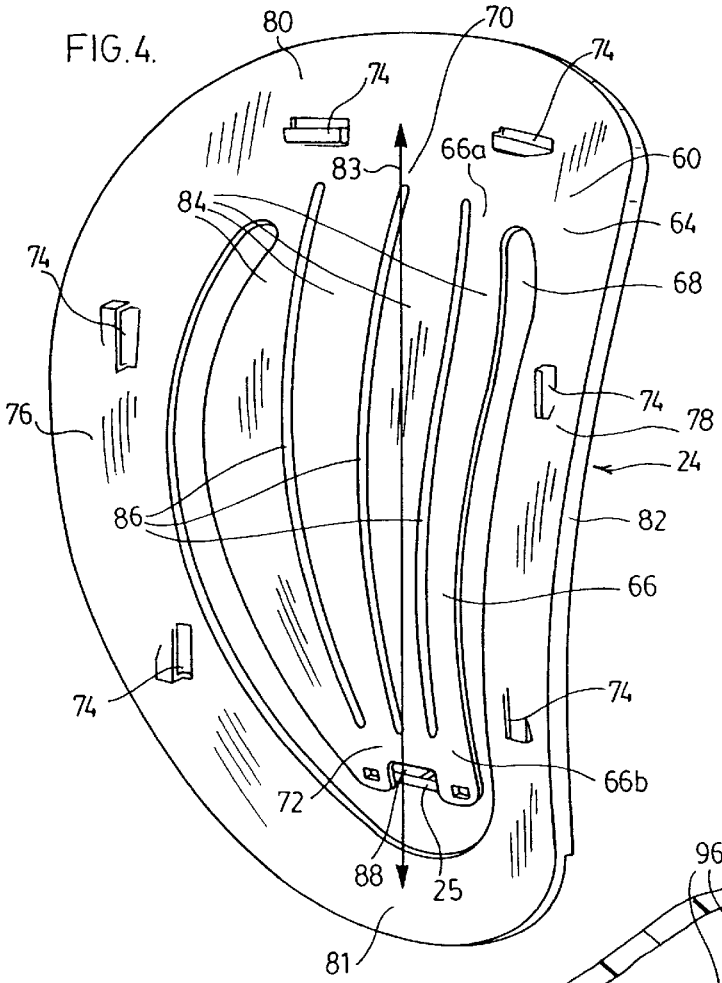
FIG. 4 is a front perspective view of a lumbar support shell of the backrest of FIG. 1.

In accordance with the shell and frame assembly of the instant invention, support shell 24 is adapted to be mounted on frame 22 and to provide a mount for flexible support section 66. Accordingly, support shell 24 may be of any particular shape which is sized to be received on frame 22. As shown in FIG. 4, support shell 24 has a top 80, a bottom 81, a front surface 60, a rear surface 62, left side 76, a right side 78 and rim 64. Top 80 and bottom 81 define a longitudinal axis 83, which is preferably generally parallel to the longitudinal axis 44 of frame 22, when support shell 24 is mounted on frame 22. This shell construction exemplifies the lumbar adjustment mechanism and the conformable backrest.

To provide an adjustable lumbar support member, flexible support is provided. Section 66 may be of any configuration which will bow outwardly when compressed to provide variable lumbar support to a person seated in a chair to which backrest 20 is affixed. When at least one of the upper end 66*a* and lower end 66*b* of flexible support section 66 is displaced towards the other, flexible support section 66 is compressed and bows outwardly (frontwardly) to provide support (or an additional amount of support) to a person seated in the chair.

To permit discrete adjustments of the amount of support provided by flexible support section 66 an adjustment mechanism is provided. The adjustment mechanism is preferably manually activated. One example of such a mechanism is the use of one or more of recesses 49, 50, 51 to receive a rod 90 to hold the flexible member in a desired position. The resilience of flexible member 55 holds rod 90 in the selected recess 49, 50, 51 (see FIGS. 5, 6, and 7). Another example is a cam assembly (see FIGS. 13–15). It will be appreciated that a motor may be used to incrementally raise or lower one of ends 66*a* and 66*b* relative to the other end to adjust the amount of lumbar support which is provided.

Figure 5:
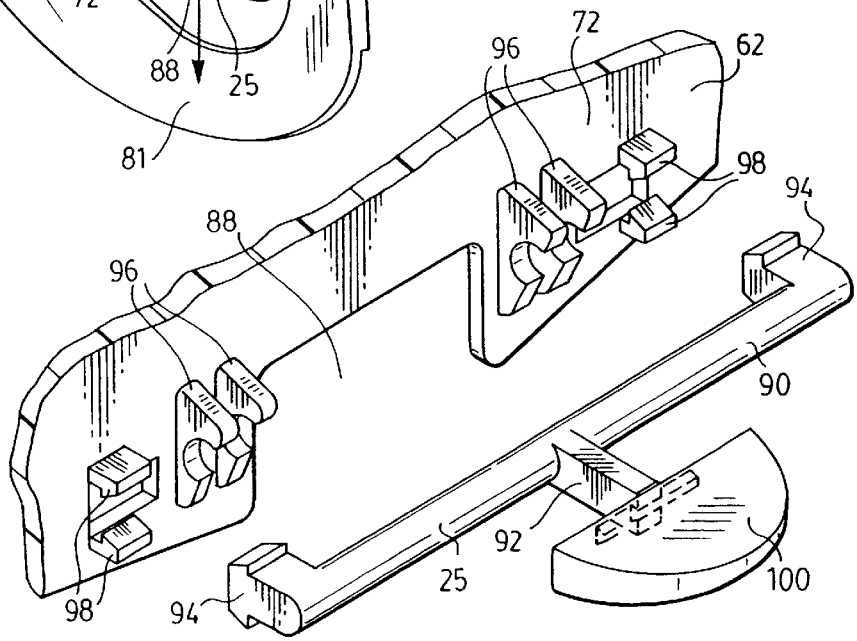
FIG. 5 is an enlarged exploded view of the handle of the backrest which is shown in FIG. 2.
Figure 6:
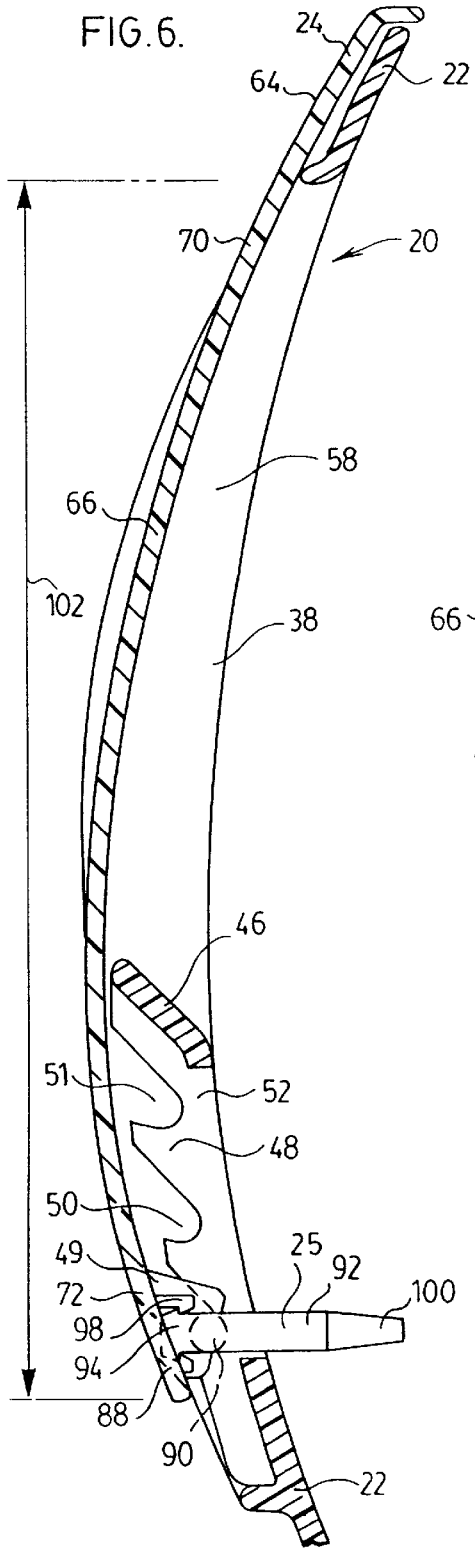
FIG. 6 is a sectional view along the line 6'—6' of the backrest of FIG. 1 in a first position.
Figure 7:
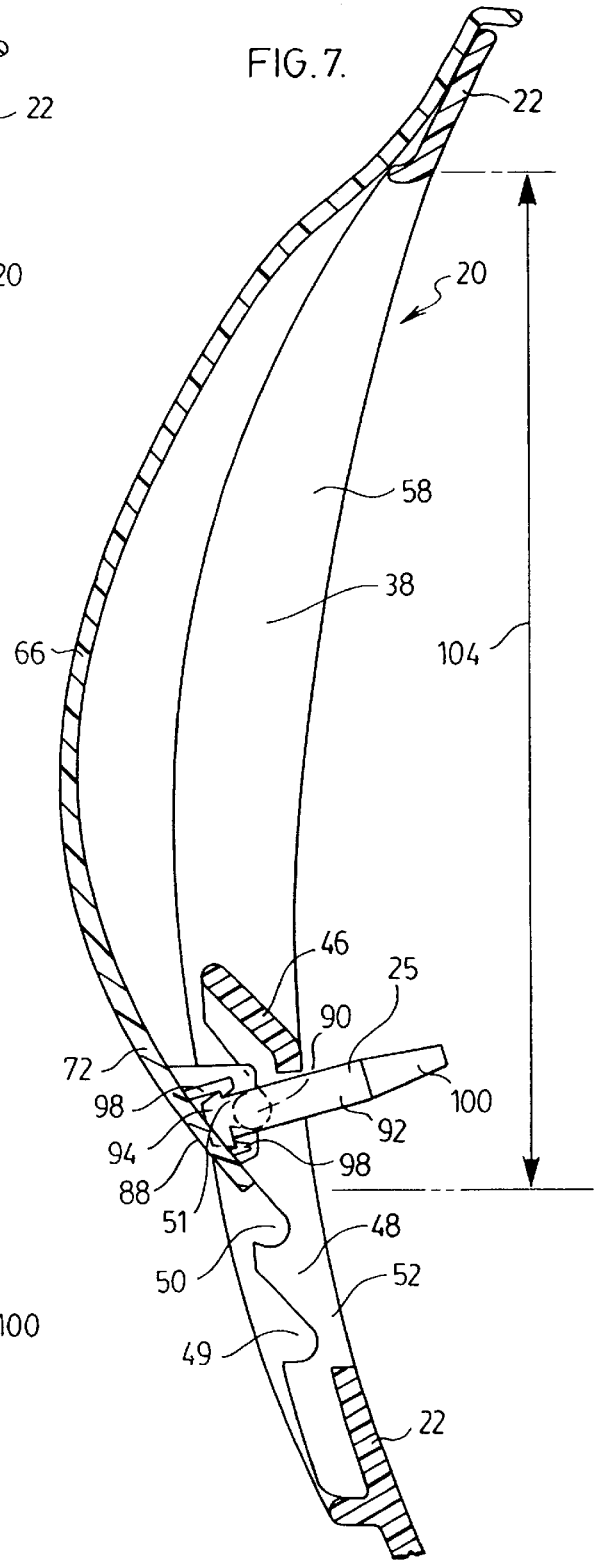
FIG. 7 is a sectional view along the line 6'—6' of the backrest of FIG. 1 in a second position.

Referring to FIGS. 5–7, a lumbar adjustment mechanism preferably uses the lumbar support member to bias a locking or retaining member into engagement with a recess on a receiving member. For example, frame 22 may be provided with at least one detent member (eg. support rib 48) for releasably receiving at least one abutment member that is drivingly connected to flexible support section 66 to retain flexible support section 66 in a desired compressed position. Preferably, the detent members have an upper surface for receiving therein the abutment member if lower end 66*b* is moveable. Flexible support section 66 may be positioned so that when backrest 20 is mounted on a chair, it provides lumbar support to a person seated in the chair. However, this arrangement may be used to provide flexible support to other portions of the back of a person and in one embodiment, provides support to the lumbar and mid back of a person.

Flexible support structure 66 advantageously utilizes a simple adjustment mechanism to allow the amount of support to be varied. In this embodiment, flexible support section 66 has a fixed end 70 and a free end 72. As shown in FIG. 4, upper end 66*a* is a fixed end 70 which is joined to rim 64, while lower end 66*b* is a free end 72 so as to be independently movable longitudinally toward or away from fixed end 70. In such an embodiment, it will be appreciated that support shell 24 and frame 22 may be integrally molded as a unit. In such a case the integral unit comprises a support structure for the flexible support section 66. Regardless of the mechanism used, frame 22 and shell 24 define a one piece assembly and provide a support for flexible support section 66 so that free end 72 of may be moved along axis 83 whereby the compression of section 66 biases the adjustment member (eg. rod 90) into the detent member (eg. notches or recesses 49, 50, 51) without significantly deforming frame 22 and shell 24.

In one aspect of this invention there is provided a flexible support section 66 which is not adjustable to vary the amount of support provided. In such a case, flexible support section 66 extends vertically from one opposed side of perimeter 64 to the other opposed side of perimeter 64. In such an embodiment, the advantages of the simplified construction of the flexible back rest this design is still obtained. Further, the back rest assembly may be conformable to the back of a user seated in the chair.

In the preferred embodiment shown in FIGS. 1, 3 and 4, the support for flexible support section 66 utilizes the frame and shell construction of one aspect of this invention. According to this two piece construction, support shell 24 may be mounted to frame 22 by any means known in the art. Accordingly, support shell 24 and frame 22 may be releasably mounted together by releasable male and female engagement members. Alternately, support shell 24 and frame 22 may be permanently connected together by mechanical means (eg. screws or rivets) or by chemical means (eg. an adhesive of spot welding) or by the non-releasable interengagement of elements.

In the embodiment of FIGS. 2 and 3, shell 24 and frame 22 are assembled together by first and second engagement members that are preferably male and female engagement members 36 and 74. Male engagement members 36 comprise a plurality of mounting tabs spaced around the periphery of an opening 38 (see FIG. 3). Each mounting tab 36 has a hook 37. Female engagement members 74 comprises a plurality of mounting slots which are positioned to receivably engage mounting tabs 36.

As shown in FIG. 4, rim 64 has a plurality of mounting slots 74 which are aligned with mounting tabs 36 of frame 22. Support shell 24 is mounted on frame 22 by inserting mounting tabs 36 through mounting slots 74. The hook 37 of each mounting tab 36 catches one side of the corresponding mounting slot 74 and thereby holds support shell 24 fixedly on the front surface of frame 22. It will be appreciated that the female engagement membrane may be provided on either frame 22 or shell 24.

Support shell 24 is preferably sized such that rim 64 extends slightly outwardly of the edge of frame 22 along its left side 76 and its right side 78 and its top 80. A lip 82 may be formed along left side 76, right side 78 and top 80 of support shell 24. Lip 82, which preferably extends rearwardly from the surface of support shell 24, may be provided to add rigidity to rim 64 and define a recess for receiving shell 22.

If flexible support section 66 is constructed to permit it to be compressed. Section 66 may be a thin plastic plate. To increase its deformability or to permit it to conform to the back of a user, flexible support section 66 is preferably divided into a plurality of slats 84 by longitudinal slots 86. In the preferred embodiment shown in the Figures, there are three slots 86 providing four slats 84 however, more or less slats may be provided. If flexible support member 66 is not adjustable, then slats 84 preferably extend from top 80 of shell 24 to the bottom of shell 24. If flexible support member 66 is adjustable, then slats 84 preferably extend from top 80 of shell 24 towards the bottom of shell 24. For example, support shell 24 may have an outer rim or perimeter 64 and a flexible support section 66 is provided centrally therein and is are separated by a generally U-shaped slot 68. U-shaped slot 68 may be shaped to conform with reinforcing wall 58 of frame 22, so that when support shell 24 is mounted on frame 22, reinforcing wall 58 extends through slot 68. Optionally, a reinforcing wall 58 surrounds opening 38 and web 46 on the front side of frame 22. Reinforcing wall 58 provides rigid support to frame 22 to reduce its flexibility when backrest 20 is in use.

The amount of support provided by flexible support section 66 is preferably varied by an adjustment member which is drivingly connected to free end 72 and a detent member locking free end 72 in a desired position. The detent members may selectively receive the adjustment member in one of a plurality of positions and flexible support member 66 biases the adjustment member into retaining engagement with the detent member due to the compression of flexible support section 66 by the displacement of the free end 72 towards the fixed end 70. Preferably, the detent member comprise a plurality of vertically spaced apart members each of which has a downwardly extending recess and the adjustment member is sized to be received in each recess. Preferably, the detent member comprises a plurality of support ribs 48 on the front side of web 46. Each support rib 48 has a plurality of notches, e.g. a lower notch 49 a middle notch 50 and an upper notch 51, which are vertically spaced apart. The lower notches 49 of all the support ribs 48 are aligned. Similarly, the middle notches 50 are aligned and the upper notches 51 are aligned. At the bottom center of free end 72, a cavity 88 may be provided. Cavity 88 is aligned with support ribs 48 when support shell 24 is mounted on frame 22 and is made wide enough to allow all of the support ribs 48 to pass through it.

As shown in FIG. 3, base section 28 has four support ribs 48 each of which has three notches 49, 50 and 51. In a different embodiment of a backrest according to the present invention, a different number of support ribs, having a different number of notches, may be provided. If free end 72 is provided at top end 66*a*, then the notches will open downwardly and provided at top 80. To cover the adjustment mechanism, web 46 may be provided with frame 22. Web 46 may be separately molded and affixed to frame 22 (see FIG. 2). Web 46 has a longitudinal slot 52 centered between the two central support ribs 48 to allow handle 100 to move longitudinally therethrough. Slot 52 extends below the lower notch 49 and above the upper notch 51 in each of support ribs 48.

FIG. 5 shows the adjustment member 25 positioned adjacent the free end 72 of flexible support section 66 from rear side 62. Adjustment member 25 utilizes a rod which is removably receivable into downwardly extending notches 49, 50 and 51. Notches 49, 50 and 51 need not be sized to lockingly receive rod 90 since due to the compression of flexible support section 66, rod 90 is biased downwardly into the notch with which it is aligned.

Preferably, rod 90 is removably mounted to free end 72 by releasable engagement members. An example of such an assembly is shown in FIG. 5. Accordingly, adjustment member 25 may also comprise an arm 92 and a pair of hooks 94 (male engagement members). Flexible support section 66 has a pair of mounting clamps 96 and a pair of opposed mounting tabs 98 on each side of cavity 88. Mounting clamps 96 cooperate with rod 90 and mounting tabs 98 (female engagement members) cooperate with hooks 94 to hold adjustment member 25 in position at the bottom rear side of flexible support section 66. Hooks 94 are inserted into tabs 98 and rod 90 is inserted into clamps 96. Tabs 98 and hooks 94 cooperate to prevent adjustment member 25 from being pulled from flexible support section 66 by a rearward force. Clamps 96 and rod 90 prevent adjustment member 25 from twisting upward or downward when adjustment member 25 is moved during the use of backrest 20. Arm 92 extends rearwardly from the center of rod 90. As shown in FIG. 2, arm 92 extends through slot 52 in frame 22 if web 46 is provided. A handle 100 is affixed to the end of arm 92.

Frame 22 and support shell 24 may be manufactured from plastic or another material. Preferably, frame 22 is substantially rigid so that it will not flex when backrest 20 is in use. Optional reinforcing wall 58 provides additional rigidity to frame 22. Similarly, optional rim 64 of support shell 24 is preferably substantially rigid and lip 82 provides added rigidity for rim 64. As noted above, optional reinforcing ridge 27 provides rigidity to mounting section 26. Flexible support section 66, however, is preferably flexible so that when free end 72 is moved closer to or further away from fixed end 70, flexible support section 66 flexes to become more or less convex, as viewed from the front side 60 of support shell 24 (FIGS. 6 and 7).

The adjustment of back rest 20 to provide differing levels of lumber support will now be explained with reference to FIGS. 6 and 7. FIG. 6 shows backrest 20 configured to provide a relatively low level of lumbar support. FIG. 7 shows backrest 20 configured to provide an increased level of lumbar support. Referring to FIG. 6, rod 90 of adjustment member 25 (which is fixedly attached to the bottom rear side of flexible support section 66) is positioned in notch 49. The distance between the top of fixed end 70 and the bottom of free end 72 of flexible support section 66 is distance 102. Flexible support section 66 appears convex when viewed from the side of backrest 20.

To increase the degree of lumbar support provided by backrest 20, and more particularly by flexible support section 66, a user may grasp handle 100 and lift adjustment member 25 from notch 49 and place it in notch 50 or notch 51. In order to do this, the user must first simultaneously move adjustment member 25 forward and upward, then lift adjustment member 25 to the appropriate height depending on the notch 50 or 51 in which arm 90 is to be inserted and then pull adjustment member 25 back to seat arm 90 in the selected notch. Since adjustment member 25 is fixedly attached to the bottom rear side of flexible support section 66, moving adjustment member 25 from notch 49 to notch 50 or notch 51 will decrease the distance between fixed end 70 and free end 72 of flexible support section 66.

FIG. 7 shows arm 90 of adjustment member 25 positioned in notch 51. The distance between the top of fixed end 70 and the bottom of free end 72 is distance 104. Distance 104 is substantially less than distance 102. As a result, the convexity of flexible support section 66 when viewed from the side of backrest 20 has been increased. A user seated on the chair to which backrest 20 has been attached will receive greater lumbar support from flexible support section 66, when it is configured as shown in FIG. 7 than when it is configured as shown in FIG. 6.

A user may return backrest 20 to the configuration of FIG. 6 by grasping handle 100 and moving adjustment member 25 such that arm 90 is released from notch 51 and then lowering adjustment member 25 and then positioning arm 90 in notch 49. Alternatively, the user may position arm 90 in notch 50 which will cause flexible support section 66 to have a degree of convexity intermediate that shown in FIGS. 6 and 7 and will provide an intermediate level of lumbar support.

In this way, backrest 20 provides a simple mechanism for adjusting the degree of lumbar support provided by backrest 20. Flexible support section 66 is configured such that it will bias its free end 72 away from fixed end 70 at all times.

Accordingly, when arm 90 of adjustment member 25 is inserted into any one of notches 49, 50 or 51, flexible support section 66 will apply a force to hold arm 90 in the selected notch.

In use, the front side of backrest 20 is normally covered by a padding material and a fabric cover (not shown). A user, therefore, does not normally lean directly against backrest 20 or flexible support section 66, but does so through the cover and the padding material.

Figure 8:
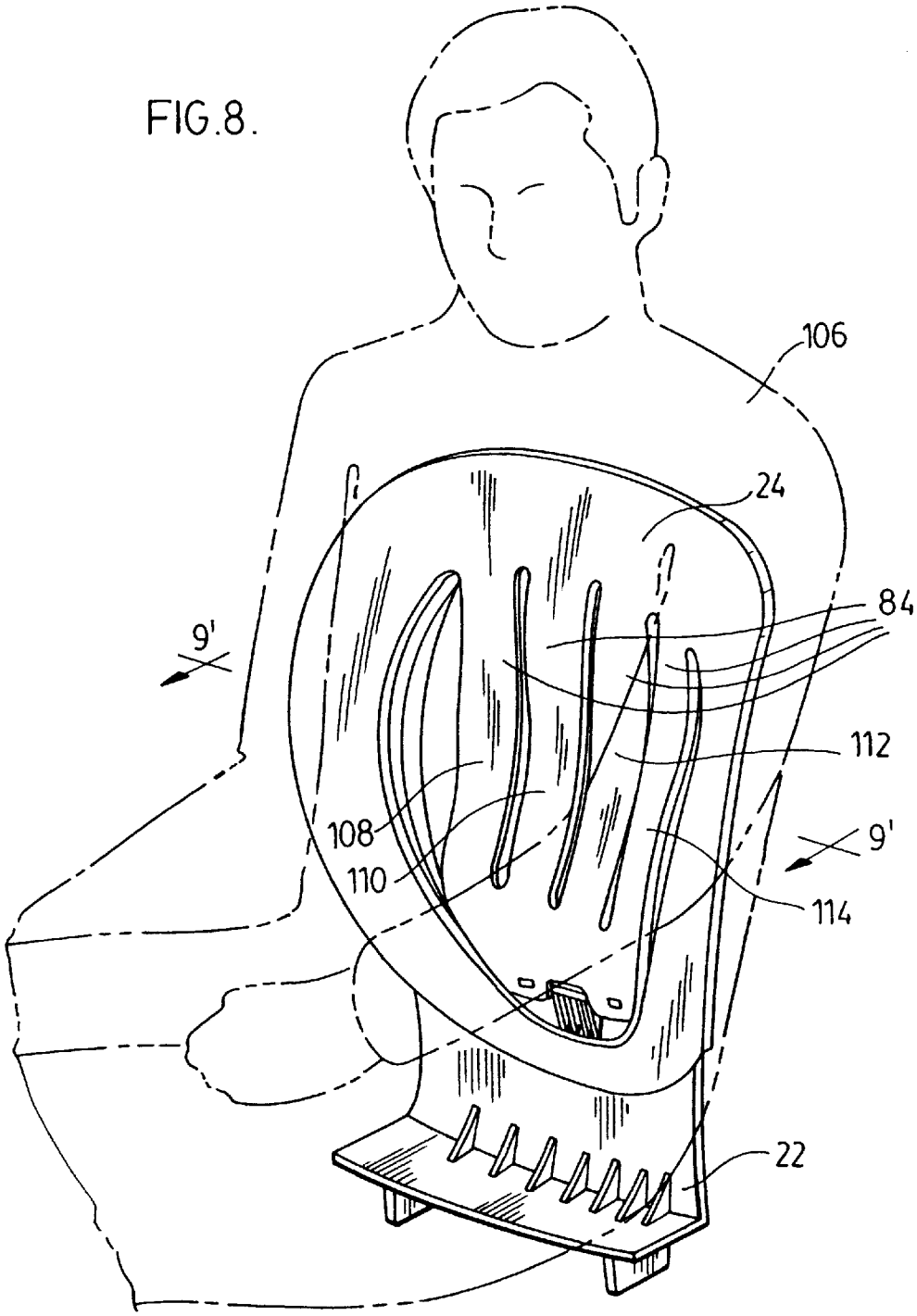
FIG. 8 is a perspective view of the backrest of FIG. 1 when in use by a person.

Reference is next made to FIG. 8 which illustrates the optional conformability of backrest 20 when slats 84 are provided. When a person 106 leans against backrest 120 and particularly against flexible support section 66, slats 84 of flexible support section 66 will be deformed rearwardly.

Figure 9:
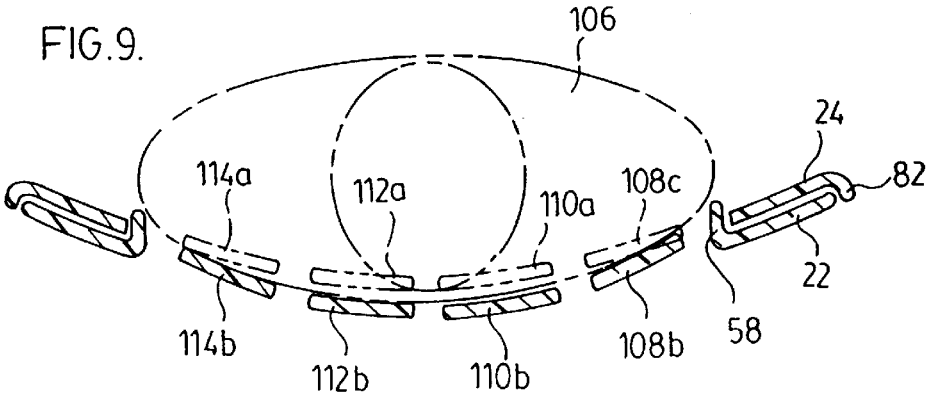
FIG. 9 is a sectional view along the line 9—9 of the backrest of FIG. 8 illustrating the flexing of the lumbar support shell when a person is seated upright in the chair.

Each slat 84 independently supports a different longitudinal portion of the user's back. As a result, a user with a wider back will cause outer slats 108 and 114 to be deformed more than would a user with a narrower back. A user with a narrower back will receive a greater proportion of lumbar support from the inner slats 110 and 112. Since slats 84 flex independently of one another, flexible support section 66 conforms to the actual shape of a particular user's back and conforms to different users who may use backrest 20 at different times, without requiring adjustment.

is made to FIG. 9. The position of slats 108, 110, 112 and 114 when backrest 20 is not in use is shown at 108*a,* 110*a,* 112*a* and 114*a,* respectively, in dotted outline. The position of slats 108, 110, 112, and 114 when a typical person is leaning against backrest 20 is shown at 108*b,* 110*b,* 112*b* and 114*b,* respectively, in solid outline. When person 106 leans against backrest 20, slats 108, 110, 112 and 114 are deformed from positions 108*a,* 110*a,* 112*a* and 114*a* to positions 108*b,* 110*b,* 112*b* and 114*b.* The deformation of each slat 108, 110, 112, and 114 will depend on the weight applied by person 106 to that particular slat.

Figure 10:
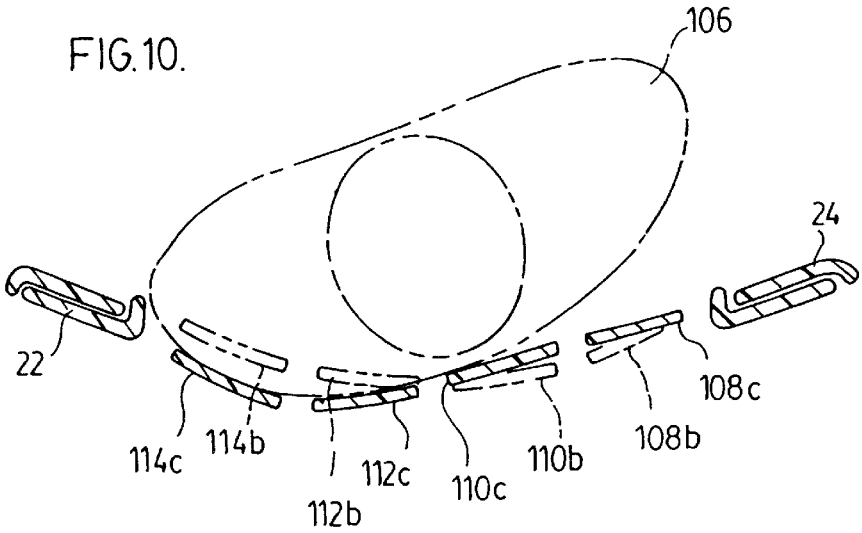
FIG. 10 is a sectional view along the line 9—9 of the backrest of FIG. 8 illustrating the flexing of the lumbar support shell when the person using it turns to one side.

Reference is next made to FIG. 10. The positions 108*b,* 110*b,* 112*b* and 114*b* of slats 108, 110, 112 and 114, respectively, when person 106 is leaning against backrest 20, as in FIG. 9, is shown in dotted outline. When person 106 turns to one side, slate 108, 110, 112 and 114 move to positions 108*c,* 110*c,* 112*c* and 114*c,* shown in solid outline. Slats 112 and 114 have deformed further backwards while allowing slat 110 to move somewhat forward and allowing slat 108 to return entirely to its unused position 108*a.*

FIGS. 8, 9 and 10 illustrate how the independent flexibility of slats 108, 110, 112 and 114 allows flexible support section 66 to reactively provide differing degrees of support to differing longitudinal portions of a user's back, depending not only on the size and shape of the user's back but also on the position in which the user is seated at any particular time. Accordingly, by using a flexible support section 66 comprising a plurality of independently movable slats 84 a back rest support is provided that will not only conform to the shape of the back of a user but will also conform to the position of the back of a user as the user moves in the chair.

Figure 12:
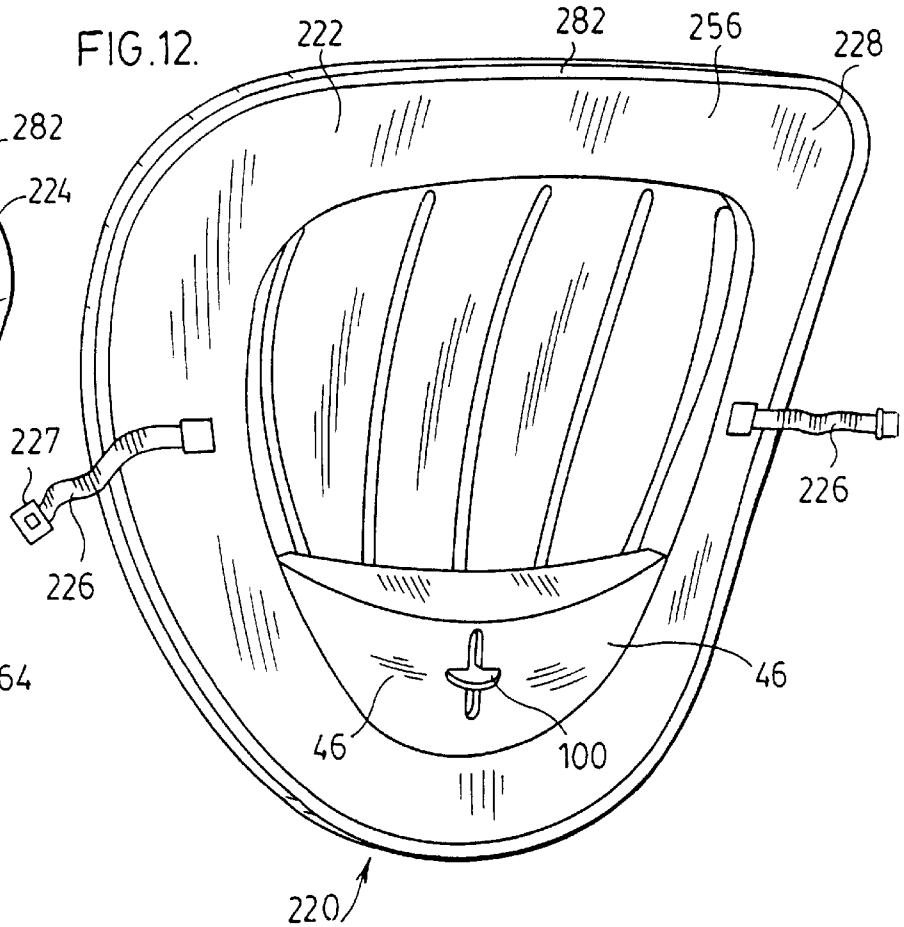
FIG. 12 is a rear perspective view of the backrest of FIG. 11.
Figure 11:
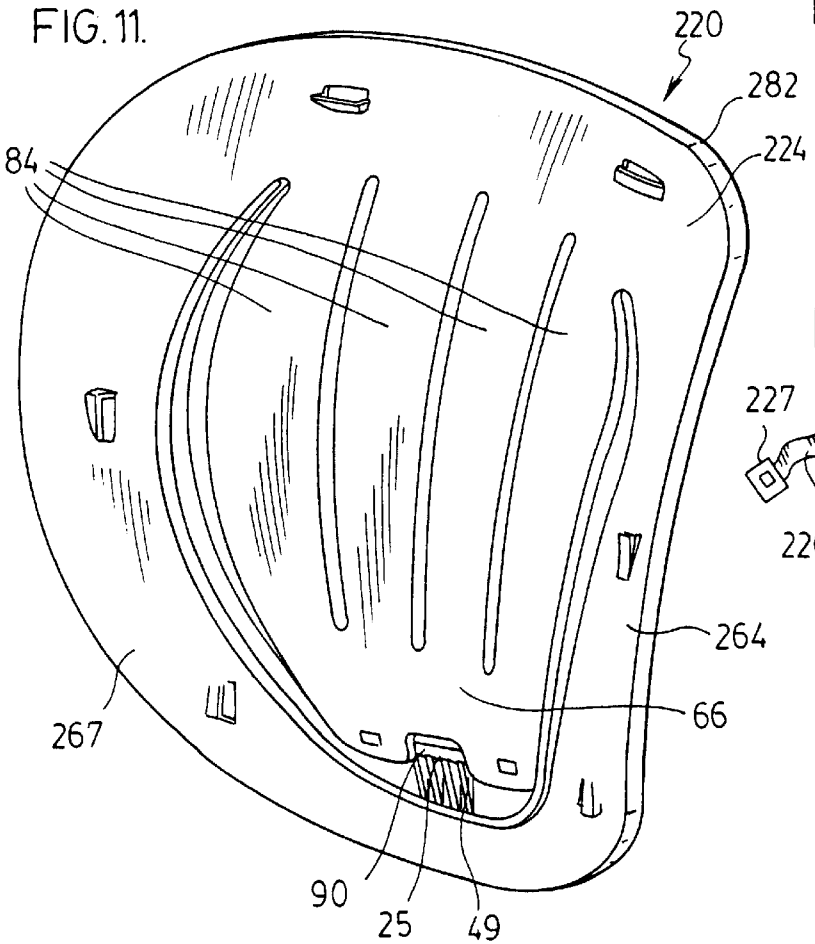
FIG. 11 is a front perspective view of a second embodiment of a backrest according to the present invention.

Reference is next made to FIGS. 11 and 12, which illustrate another exemplary backrest 220 made according to the present invention. Backrest 220 comprises of a frame 222, a support shell 224 and an adjustment member 25. Backrest 220 is similar to backrest 20 in structure and operation, except that back rest 220 is designed for portable use with different chairs, rather than for mounting on a single chair. Components of backrest 220 which are identical to corresponding components of backrest 20 are identified by the same reference numerals.

Frame 222 has a base section 228, but does not have a mounting section. Instead, backrest 220 has a pair of mounting straps 226 affixed to the rear side 256 of frame 222. Straps 226 may be provided with buckles 227 and may be used to attach backrest 222 in front of the backrest of a typical chair (not shown), thereby adding the functionality of backrest 222 to the chair.

Rim 264 of support shell 224 extends beyond the perimeter of base section 228 on all sides. A lip 282 is formed around the perimeter of rim 264 to provide rigidity to rim 264.

Backrest 220 is adjusted to provide differing levels of lumbar support in exactly the same manner as described above for backrest 20. Depending on the construction of the chair (not shown) to which backrest 220 is attached, it may be necessary to adjust backrest 220 by positioning rod 90 in the appropriate notch 49, 50 or 51 (notches 50 and 51 not shown in FIGS. 11 and 12) prior to affixing backrest 220 on the chair (i.e. if the backrest of the chair would obstruct handle 100).

Backrest 20 and backrest 220 have been described as providing lumbar region of a user's back. Depending on the vertical contour of the support section of the backrest, support may be provided to lumbar, medial and upper regions of the back simultaneously. Such an embodiment of a backrest according to the present invention may support both the vertically central section of the user's back (along the spine) and the lateral sides (i.e. the left and right sides) of the user's back.

Figure 13:
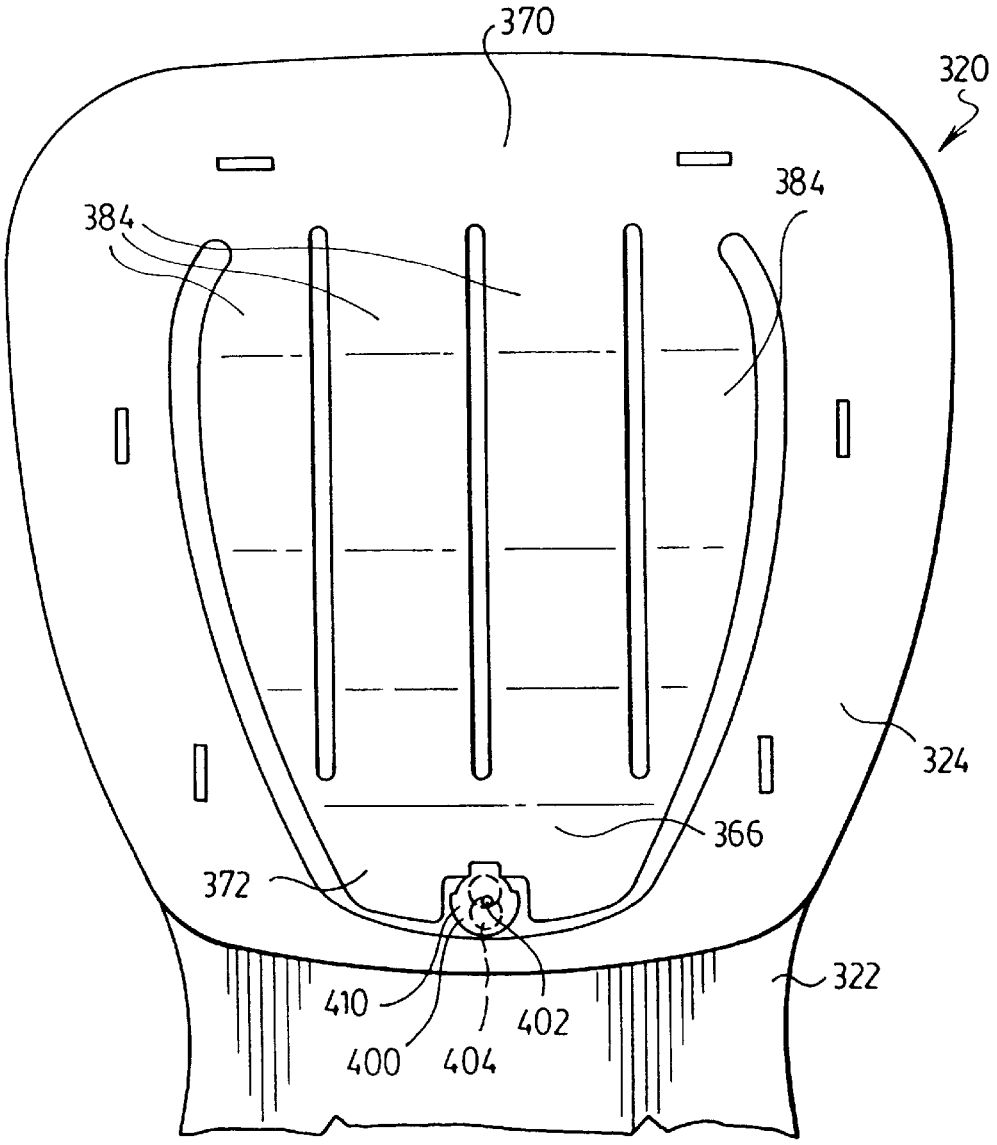
FIG. 13 is a front view of an alternate embodiment of the backrest of FIG. 1.

Reference is next made to FIG. 13, which illustrates an alternate embodiment of a lumbar adjustment member according to the present invention. Elements of backrest 320 that corresponds to elements of backrest 20 are identified by similar reference numerals increased by 300. Backrest 320 has a frame 322 and a support shell 324. Like support shell 24, support shell 324 has optional slats 384 that extend vertically between a fixed end 370 and a free end 372 of a flexible support section 366. Flexible support section 366 is adjustable to vary the amount of support provided by slats 384 by increasing the longitudinal distance between the fixed end 370 and the free end 372 of flexible support section 366.

The support ribs 48 and rod 90 of backrest 20, which are used to adjust the amount of lumbar support provided by backrest 20, are not provided in backrest 320. Instead, the lumbar support provided by backrest 320 is controlled using a rotary cam. Backrest 320 utilizes a rotary adjustment mechanism 400.

Figure 14:
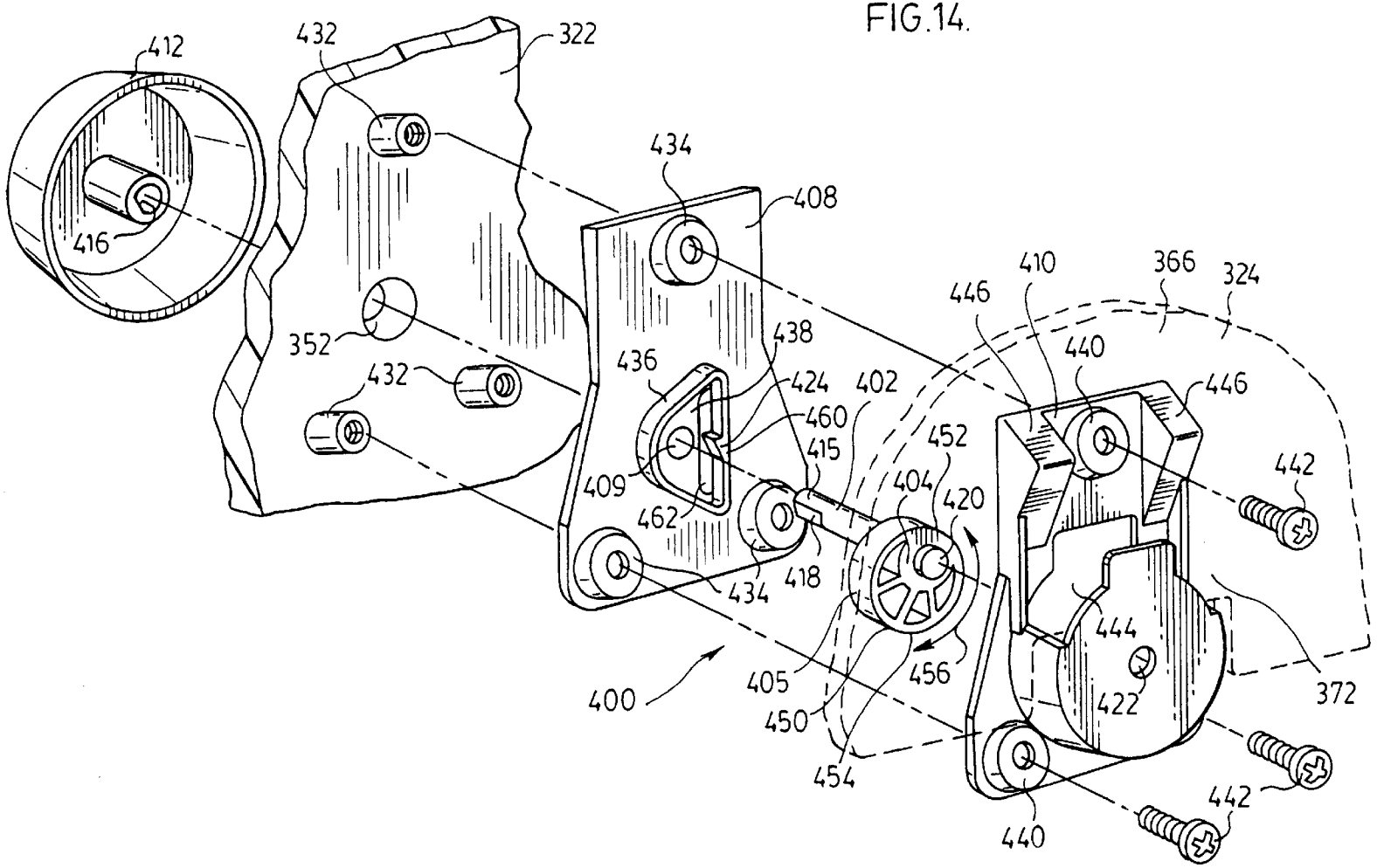
FIG. 14 is an exploded view looking outwardly of the adjustment mechanism of the alternate embodiment of FIG. 13; and, FIG. 15 is an exploded view looking inwardly of the adjustment mechanism of the alternate embodiment of FIG. 13.
Figure 15:
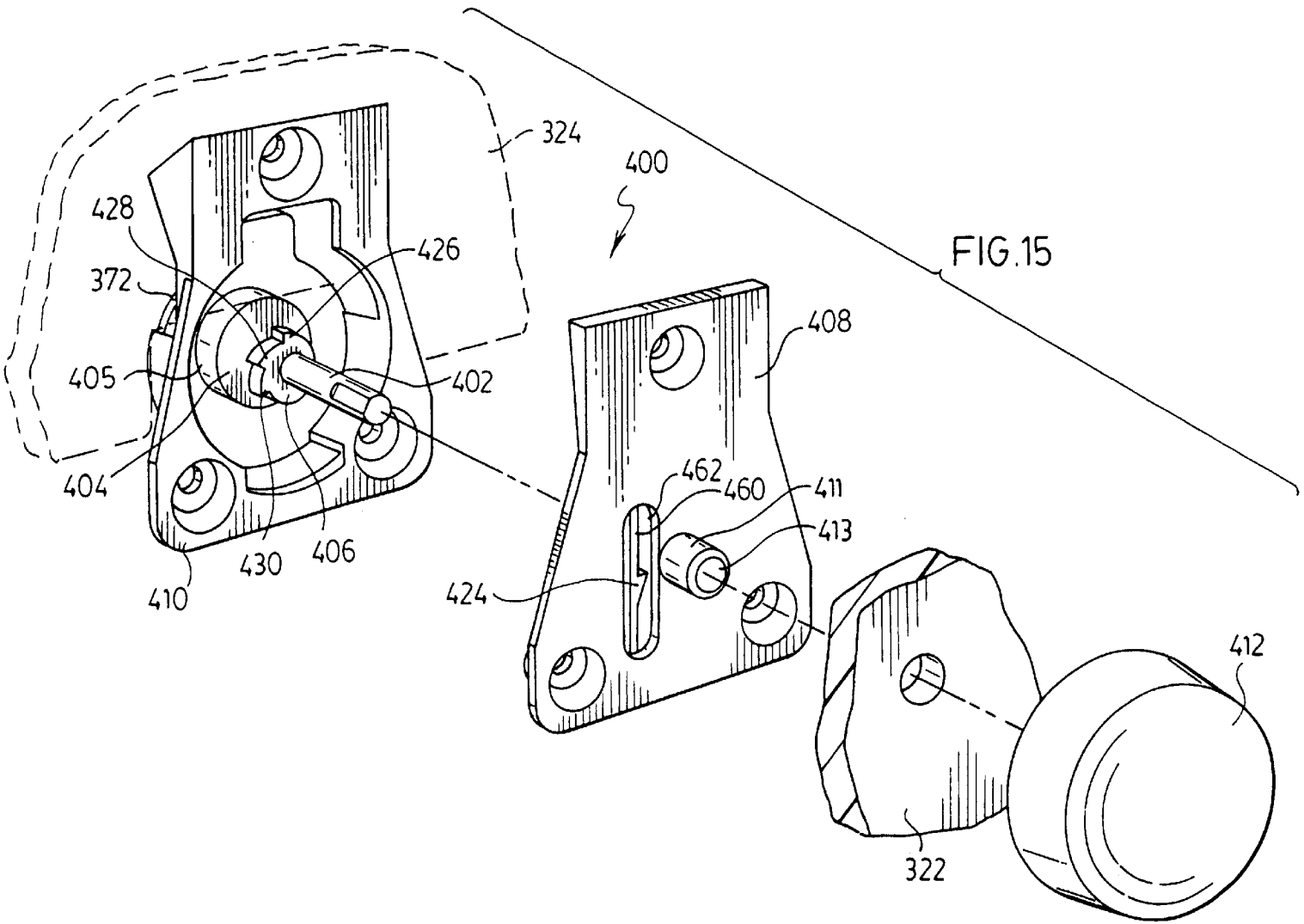

Mechanism 400 is illustrated in FIGS. 14 and 15 and comprises a control shaft 402, a cam 404, toothed wheel 406, a base plate 408, a cover plate 410 and a knob 412.

A control end 415 of shaft 402 extends through orifice 409 in base plate 408 and through orifice 352 in frame 322. Orifice 409 may optionally be continued on the back of base plate 408 using a shaft support sleeve 411 with a lumen 413. Orifice 409 and lumen 413 may be sized to be slightly larger than shaft 402 and may provide support for shaft 402. Control end 415 has a flat section 418 which engages a key 416 in knob 412 when knob 412 is pressed onto control end 415. Flat section 418 and key 416 cooperate to non-rotationally mount knob 412 on shaft 402 so that shaft 402 may be rotated by turning knob 412. Alternatively, control end 415 and knob 412 may have a different engagement mechanism. For example, one of control end 415 or knob 418 may be provided with a series of ribs or splines and the other may be provided with complementary grooves; one of control end 415 or knob 412 may be provided with a set screw and the other may have a complementary recess for receiving the screw. Any other mechanism for rotationally engaging knob 412 and shaft 402 may be used such as gluing or welding them together.

Shaft 402 is supported for rotational movement in mechanism 400. For example, a bearing may be used. As shown in FIGS. 14 and 15, shaft 402 has a supported end 420 opposite its control end 415. Supported end 420 extends through an orifice 422 in cover plate 410. Cam 404 and toothed wheel 406 are nonrotationally mounted on shaft 402 and may be formed integrally with shaft 402. Cam 404 is mounted adjacent supported end 420. Cam 404 may be mounted off-center on shaft 402 so that, when shaft 402 is rotated about its axis the side surface 405 appears to move axially inwards and outwards when viewed from a fixed position to provide an eccentricity.

Base plate 408 includes a hook 424. Hook 424 functions as a detent member. Toothed wheel 406 is mounted on shaft 402 such that teeth 426, 428 and 430 sequentially engage hook 424 when mechanism 400 is assembled. Hook 424 is formed on a cam support 436, which may be formed integrally with or may be mounted on base plate 408. Cam support 436 defines a cavity 438 in which toothed wheel 406 fits. Cam support 436 may be sized so that cam 402 rests against camp support 436 when mechanism 400 is assembled. Optionally, hook 424 is mounted on a flexible section 460 of cam support 436. To allow section 460 to flex, a gap 462 may be formed in backing plate 408. Hook 424 may also be supported by a separate element than is used to support cam 404.

Mechanism 400 may be assembled by positioning base plate 408 on frame 322 so that orifice 409 is aligned with orifice 352. Frame 322 may be provided with optional mounting bosses 432 and base plate 408 may be provided with complementary mounting sections 434 to allow base plate 408 to be conveniently positioned on frame 322. Control end 415 of shaft 402, which has cam 404 and toothed wheel 406 attached to or formed integrally with it, is then inserted though orifices 409 and 352 so that toothed wheel 406 is positioned within cavity 438 and cam 402 is positioned adjacent cam support 436. Cover plate 410 may then be positioned over cam 402 and base plate 408 so that supported end 420 passes into or through orifice 422. Cover plate 410 may be provided with optional mounting sections 440 aligned with bosses 432. Mechanism 400 may be held in place on frame 322 using fasteners 442, which may be screws or any type of fastener. Alternatively, mechanism 400 may be held in place by fixing base plate 408 to frame 322 and fixing cover plate 410 to base plate 408 or to frame 322 with an adhesive cement or glue. Alternatively, mechanism 400 may be held in place using mounting tabs with hooks and mounting slots similar to mounting tabs 36, hooks 37 and mounting slots 74 of back rest 20. Knob 412 may then be positioned on the control end 415 of shaft 402.

When backrest 320 is assembled, the free end 372 of flexible support shell 366 is inserted through opening 444 in cover plate 410. The bottom side of free end 372 is positioned against the side surface 405 of cam 404. Cover plate 410 may be provided with one or more optional guiding members 446 to help position support free end 372 in opening 444.

The amount of support provided by backrest 320 is adjusted by rotating knob 412 so that one of teeth 426, 428 or 430 engages hook 424, thereby fixing the position of cam 404. Since shaft 402 is eccentrically mounted in cam 404, the side surface 405 of cam 404 will move the free end 372 of flexible support member 366 upwards or allow it to move downwards (i.e. towards or away from fixed end 370 of flexible support member 366) as knob 412 is rotated. As a result, the longitudinal distance between fixed end 370 and free end 372 is varied and the amount of support provided by backrest 320 may be controlled, as was described with reference to FIGS. 6 and 7 in the case of backrest 20.

Backrest 320 will provide its maximum support when point 450 of the side surface 405 of cam 404 is touching free end 372 of flexible support section 366 and will provide its minimum support when point 452 of side surface 405 is touching free end 372. One skilled in the art will understand that free end 372 will exert a downward force on cam 404, which may cause cam 404 to spin about the axis of shaft 402. Accordingly, teeth 426, 428 and 430 are preferably positioned such that this downward force will be opposed by the engagement of the tooth engaged with hook 424. Accordingly, one tooth is preferably positioned such that point 454, which is adjacent point 452, is held against free end 372 and the remaining teeth are positioned so that points on side surface 405 between point 454 and point 452, on arc 456, are held against free end 372. Due to the downward force applied by free end 372 on cam 404, no tooth is required to hold cam 404 in its lowest support position (i.e. in a position where point 452 is held against free end 372). FIG. 13 illustrates backrest 320 when cam 404 is positioned to maximize the amount of support provided by backrest 320.

In an alternative embodiment of a backrest according to the present invention, any mechanism for holding cam 404 in place may be used in place of teeth 426, 428, 430 and hook 424.

Backrests 20, 220 and 320 have been described as providing lumbar region of a user's back. Depending on the vertical contour of the support section of the backrest, support may be provided to lumbar, medial and upper regions of the back simultaneously. Such an embodiment of a backrest according to the present invention may support both the vertically central section of the user's back (along the spine) and the lateral sides (i.e. the left and right sides) of the user's back.

These and other variations of a backrest according to the present invention will be within the competence of a person skilled in the art. All such variations fall within the scope of the present invention, which is limited only by the following claims.

I claim:

1. A backrest for supporting a person's back having a front surface and a rear surface, the backrest comprising:

(a) a member having an outer perimeter and a flexible support section, the flexible support section having a fixed end which is connected to a portion of the perimeter and a free end positioned distal to the fixed end, the flexible support section is configured to be displaced forwardly when the free end is moved towards the fixed end;

(b) an adjustment member drivingly connected to the free end; and, (c) a detent member for selectively receiving the adjustment member in one of a plurality of positions, the flexible support section biasing the adjustment member into retaining engagement with the detent member due to compression of the flexible support section by the displacement of the free end towards the fixed end.

2. The backrest as claimed in claim 1 wherein the flexible support section comprises a plurality of slats extending vertically between the fixed end and the free end of the flexible support section.

3. The backrest as claimed in claim 2 wherein the slats extend from a position adjacent the fixed end to a position adjacent the free end.

4. The backrest as claimed in claim 1 wherein the fixed end comprises an upper end and the free end comprises a lower end and the detent member comprises a plurality of vertically spaced apart members each of which has a downwardly extending recess and the adjustment member is sized to be received in each recess.

5. The backrest as claimed in claim 1 wherein the detent member comprises a plurality of vertically spaced apart members each of which has a recess to receive therein the adjustment member and said support section biases the adjustment member into engagement with the recesses.

6. The backrest as claimed in claim 1 wherein the backrest has a rear face with a vertically extending opening adjacent the free end, the adjustment member is mounted at the free end of the flexible support section and has a handle which extends through the vertically extending opening whereby the flexible support section may be adjusted from the rear of the backrest.

7. The backrest as claimed in claim 1 wherein the detent member comprises a gear arrangement.

8. The backrest as claimed in claim 7 wherein the gear arrangement is mounted on a shaft and the adjustment member comprises a cam eccentrically mounted on the shaft.

9. The backrest as claimed in claim 1 wherein the adjustment member comprises an eccentrically mounted cam.

10. The backrest as claimed in claim 1 wherein the backrest comprises a frame and the member comprises a shell mounted on the frame.

11. The backrest as claimed in claim 10 wherein the frame has an opening sized to receive therein the flexible support section.

12. The backrest as claimed in claim 11 wherein the perimeter section surrounds a central section in which the flexible support section is provided and, when mounted on a chair, the flexible support section has a vertical extent sufficient to support at least the lumbar region of the person when seated in the chair.

13. The backrest as claimed in claim 10 wherein the shell has first engagement members and the frame has second engagement members configured to engage the first engagement members whereby the engagement of the first and second engagement members retains the shell on the frame.

14. The backrest as claimed in claim 13 wherein one of the first engagement members and the second engagement members comprise a plurality of openings and the other of the first and second engagement members comprises projecting members that are lockingly received in the openings.

15. A backrest for supporting a person's back having a front surface and a rear surface, the backrest comprising:

(a) a flexible support section having a fixed end which is mounted to a support structure and a free end which is displaceable vertically with respect to the fixed end, the support section is configured to be compressed and displaced forwardly when the free end is moved towards the fixed end;

(b) an eccentrically mounted cam drivingly connected to the free end; and, (c) a locking member for retaining the free end at a fixed position with respect to the fixed end.

16. The backrest as claimed in claim 15 wherein the flexible support section comprises a plurality of slats extending vertically between the fixed end and the free end of the support section.

17. The backrest as claimed in claim 15 wherein the locking member comprises a detent and gear arrangement.

18. The backrest as claimed in claim 17 wherein the gear arrangement is mounted on a shaft.

19. The backrest as claimed in claim 17 wherein compression of the flexible support section biases the free end into engagement with the cam.

20. The backrest as claimed in claim 19 wherein compression of the flexible support section biases at least one tooth of the gear arrangement into locking engagement with the detent.

21. A backrest for supporting a person's back having a front surface and a rear surface, the backrest comprising:

(a) a flexible support section having a fixed end which is mounted to a support structure and a free end which is displaceable vertically with respect to the fixed end, the support section is configured to be compressed and displaced forwardly when the free end is moved towards the fixed end;

(b) an adjustment member drivingly connected to the free end; and, (c) a detent and gear arrangement for retaining the free end at a fixed position with respect to the fixed end.

22. The backrest as claimed in claim 21 wherein the support structure comprises a member having an outer perimeter to which the flexible support section is attached.

23. The backrest as claimed in claim 21 wherein the support structure comprises a member having an outer perimeter to which the flexible support section is integrally attached.

24. The backrest as claimed in claim 21 wherein the gear arrangement is mounted on a shaft and the adjustment member comprises a cam eccentrically mounted on the shaft.

25. The backrest as claimed in claim 21 wherein the adjustment member comprises an eccentrically mounted cam.

26. A backrest for supporting a person's back having a front surface and a rear surface, the backrest comprising:

(a) a flexible support section having a fixed end which is mounted to a support structure and a free end which is displaceable vertically with respect to the fixed end, the support section is configured to be compressed and displaced forwardly when the free end is moved towards the fixed end;

(b) an eccentrically mounted cam drivingly connected to the free end; and, (c) a locking member for retaining the free end at a fixed position with respect to the fixed end, the flexible support section biasing the free end to engage the locking member.

27. The backrest as claimed in claim 26 wherein the support structure comprises a member having an outer perimeter to which the flexible support section is attached.

28. The backrest as claimed in claim 26 wherein the support structure comprises a member having an outer perimeter to which the flexible support section is integrally attached.

29. A backrest for supporting a person's back having a front surface and a rear surface, the backrest comprising:

(a) a frame;

(b) a shell mounted on the frame and having an outer perimeter and a flexible support section, the flexible support section having a fixed end which is connected to a portion of the perimeter and a free end positioned distal to the fixed end, the flexible support section is configured to be displaced forwardly when the free end is moved towards the fixed end, the frame having an opening sized to receive therein the flexible support section;

(c) an adjustment member drivingly connected to the free end; and, (d) a locking member for retaining the free end at a fixed position with respect to the fixed end.

30. The backrest as claimed in claim 29 wherein the perimeter section surrounds a central section in which the flexible support section is provided and, when mounted on a chair, the flexible support section has a vertical extent sufficient to support at least the lumbar region of the person when seated in the chair.

31. The backrest as claimed in claim 29 wherein the shell has first engagement members and the frame has second engagement members configured to engage the first engagement members whereby the engagement of the first and second engagement members retains the shell on the frame.

32. The backrest as claimed in claim 31 wherein one of the first engagement members and the second engagement members comprise a plurality of openings and the other of the first and second engagement members comprises projecting members that are lockingly received in the openings.

33. A backrest for supporting a person's back having a front surface and a rear surface, the backrest comprising:

(a) a frame;

(b) a shell mounted on the frame and having an outer perimeter and a flexible support section, the flexible support section having a fixed end which is connected to a portion of the perimeter and a free end positioned distal to the fixed end, the flexible support section is configured to be displaced forwardly when the free end is moved towards the fixed end, the shell has first engagement members and the frame has second engagement members configured to engage the first engagement members whereby the engagement of the first and second engagement members retains the shell on the frame;

(c) an adjustment member drivingly connected to the free end; and, (d) a locking member for retaining the free end at a fixed position with respect to the fixed end.

34. The backrest as claimed in claim 33 wherein one of the first engagement members and the second engagement members comprise a plurality of openings and the other of the first and second engagement members comprises projecting members that are lockingly received in the openings.

* * * * *